US010371471B2

(12) United States Patent
Lee

(10) Patent No.: US 10,371,471 B2
(45) Date of Patent: Aug. 6, 2019

(54) METHODS OF FIREARM OPERATIONS

(71) Applicant: D.A. Wiese & Co., LLC, Brooklyn Park, MN (US)

(72) Inventor: Olaf N. Lee, Forest Lake, MN (US)

(73) Assignee: D.A. Wiese & Co., LLC, Brooklyn Park, MN (US)

( * ) Notice: Subject to any disclaimer, the term of this patent is extended or adjusted under 35 U.S.C. 154(b) by 1 day.

(21) Appl. No.: 15/638,927

(22) Filed: Jun. 30, 2017

(65) Prior Publication Data

US 2017/0299293 A1 Oct. 19, 2017

Related U.S. Application Data

(62) Division of application No. 14/597,001, filed on Jan. 14, 2015, now Pat. No. 9,696,102.

(60) Provisional application No. 61/927,121, filed on Jan. 14, 2014.

(51) Int. Cl.

| | |
|---|---|
| ***F41A 3/66*** | (2006.01) |
| ***F41C 3/00*** | (2006.01) |
| ***F41A 3/38*** | (2006.01) |
| ***F41A 9/55*** | (2006.01) |
| ***F41A 19/35*** | (2006.01) |

(52) U.S. Cl.

CPC ..... *F41A 3/66* (2013.01); *F41A 3/38* (2013.01); *F41A 9/55* (2013.01); *F41A 19/35* (2013.01); *F41C 3/00* (2013.01)

(58) Field of Classification Search

CPC ..... F41A 9/40; F41A 9/41; F41A 9/54; F41A 9/55; F41A 9/56; F41A 9/58; F41A 3/66; F41A 3/38

See application file for complete search history.

(56) References Cited

U.S. PATENT DOCUMENTS

| | | | | |
|---|---|---|---|---|
| 684,055 | A | 10/1901 | Gabbett-Fairfax | |
| 1,293,021 | A | 2/1919 | Browning | |
| 1,628,226 | A | 5/1927 | Browning | |
| 1,852,411 | A | 4/1932 | Henry | |
| 2,962,936 | A | 12/1960 | Lippert et al. | |
| 3,960,053 | A | 6/1976 | Conley | |
| 4,022,105 | A * | 5/1977 | White | F41A 3/26 89/149 |
| 4,155,187 | A | 5/1979 | Lichtman | |
| 4,167,890 | A | 9/1979 | Adams | |
| 4,311,082 | A * | 1/1982 | Johnson | F41A 9/37 89/185 |
| 4,915,011 | A | 4/1990 | Smith | |

(Continued)

*Primary Examiner* — Stephen Johnson

(74) *Attorney, Agent, or Firm* — Alan D. Kamrath; Mayer & Williams PC

(57) ABSTRACT

A firearm includes a frame to which a barrel and slide are slideably mounted and in which a magazine is slideably received. A bumper telescoped on a push rod slideable with the slide pushes a shell in the magazine onto a pivotal carrier. Locking wings pivotally mounted to the barrel are cammed in troughs of a cam block as the barrel and the slide parallel to the longitudinal axis of the barrel relative to the cam block, so that lock tabs are removably received in locking recesses in the slide to removably lock the barrel and slide together. A trigger is slideably mounted to the frame for movement parallel to the longitudinal axis of the barrel for pivoting a sear lever engagable with a biased striker and moving a safety from an interfering position relative to the striker.

3 Claims, 5 Drawing Sheets

(56) References Cited

U.S. PATENT DOCUMENTS

| | | | | |
|---|---|---|---|---|
| 6,079,138 | A | 6/2000 | Meaker | |
| 6,415,701 | B1 | 7/2002 | Dobbins | |
| 6,993,864 | B1 | 2/2006 | O'Clair | |
| 8,061,255 | B1 | 11/2011 | Boberg | |
| 2013/0055611 | A1* | 3/2013 | Blazek | F41A 9/41<br>42/50 |
| 2014/0068986 | A1* | 3/2014 | Pietrzyk | F41A 9/17<br>42/6 |

* cited by examiner

METHODS OF FIREARM OPERATIONS

CROSS REFERENCE

The present application is a division of application Ser. No. 14/597,001 filed on Jan. 14, 2015, now U.S. Pat. No. 9,696,102, which claims benefit of Appln. No. 61/927,121 filed on Jan. 14, 2014.

BACKGROUND

A firearm and methods of operations are disclosed in the illustrative embodiment of a pistol.

The firearms industry is relatively unchanged in the last 30 years, and there is desire in the market for firearms that do not give up reliability in exchange for size, power and the ability for interchangeability of types of rounds. Some firearms excel at compact size but give up reliability, while others offer versatility of types of rounds that can be fired but give up weight and size. Currently, there are two common methods of unlocking the slide from the barrel. One is a tilting barrel where the barrel pivots out of the way of the slide to allow the slide to slip past locking lugs that are an integral part of the barrel. The second is a rotating barrel that shifts back with the slide then rotates so that the locking lugs on the barrel disengage from the slide. The only similar methods of locking the barrel to the slide are a linear drop lock or rollers that require a much larger width of the frame and slide.

Thus, there is need in the market for reliable appropriately sized firearms that do not sacrifice any of items as sacrificed in the prior art. This need entails the need for improved methods of unloading the magazine, loading the firearm, triggering and locking the barrel to the breach face.

SUMMARY

These needs and other problems in the field of firearms are solved by positioning or retracting a locking tab of a locking wing into or from a locking recess of a slide as the slide is slid relative to a barrel to which the locking wing is mounted to and from a forward rest position relative to the barrel. In aspects shown, the locking tab is slideably received in troughs formed in a cam block which cam the locking wing into extended and retracted positions, with the slide and barrel slideable relative to the cam block.

Additionally, these needs and other problems in the field of firearms are solved by moving a bumper in a first direction against a front of the shell to push the shell in the first direction out of the top of a magazine. In aspects shown, the bumper is moved by being telescopically biased relative to a push rod which is fixed to a slide which is slideably mounted relative to a barrel and a frame into which the magazine is slideably received.

Further, these needs and other problems in the field of firearms are solved by sliding a trigger in a frame from a forward position to a rearward position to move a sear lever to disengage from a biased striker so that the striker moves from a set position to a firing position. In aspects shown, a carrier for the shell to be fired moves from a lowered position to a raised position and when moving from the lowered position to the raised position disconnects the linkage between the trigger and the sear lever to allow their return to their forward and engaged positions and a safety is moved from an interfering position to a non-interfering position.

DESCRIPTION OF THE DRAWINGS

The illustrative embodiments may best be described by reference to the accompanying drawings where.

Figure 1:
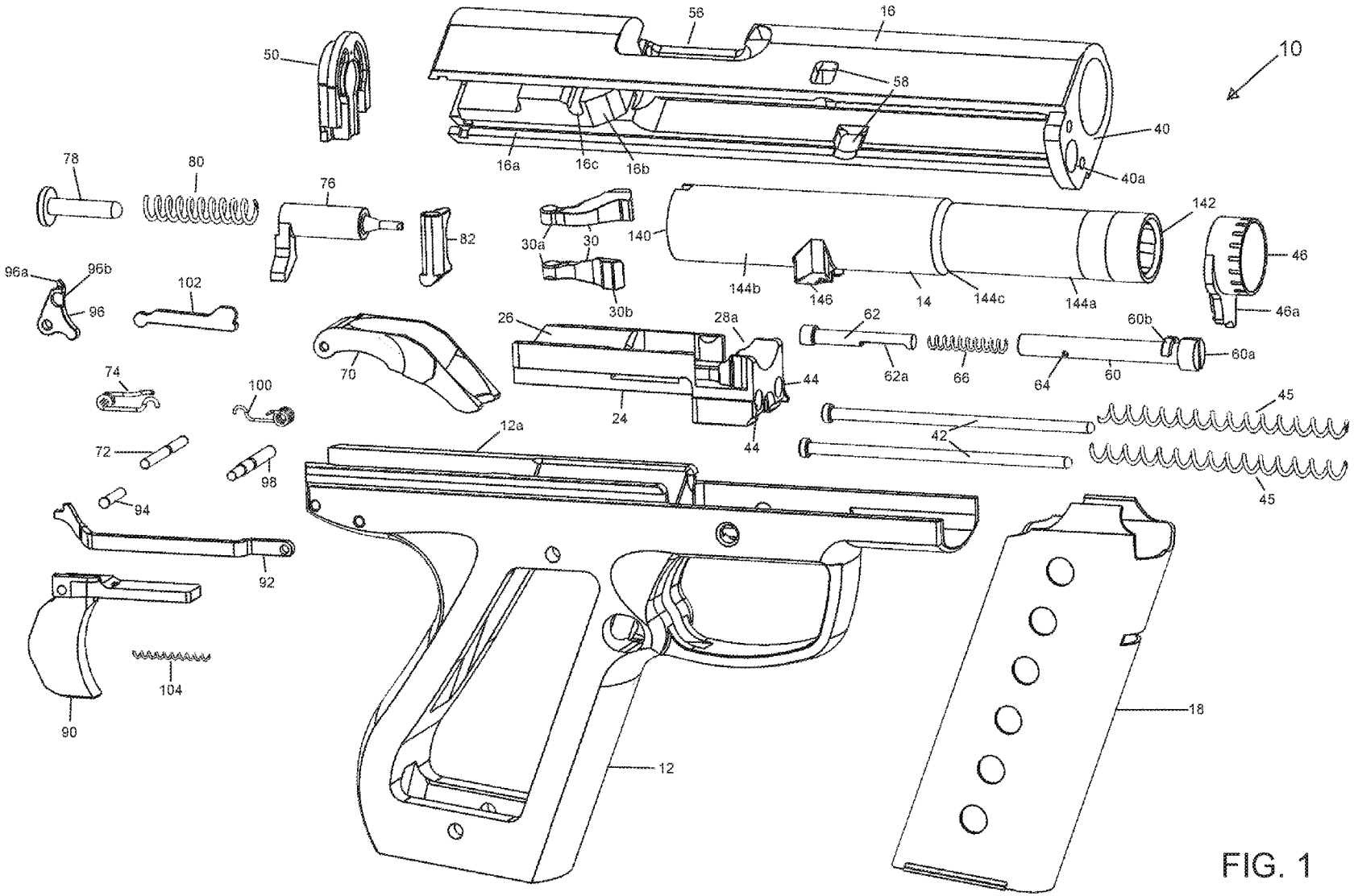
FIG. 1 shows an exploded perspective view of a firearm.
Figure 2:
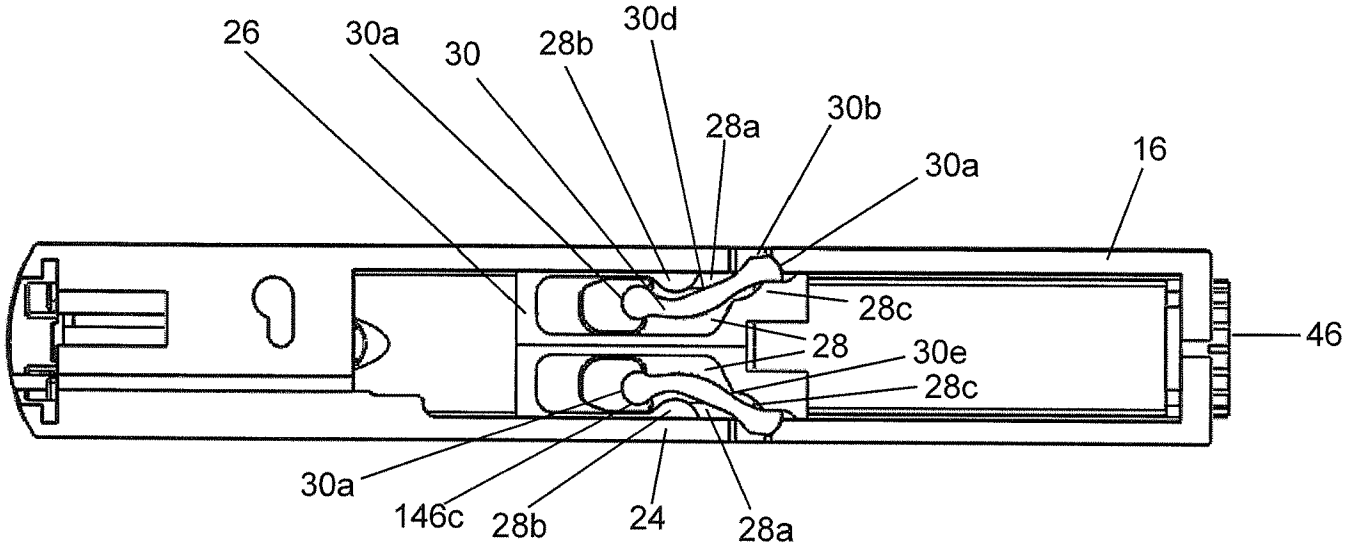
FIGS. 2 and 3 show longitudinal cross sectional views of the firearm of FIG. 1 in alternate positions.
Figure 3:
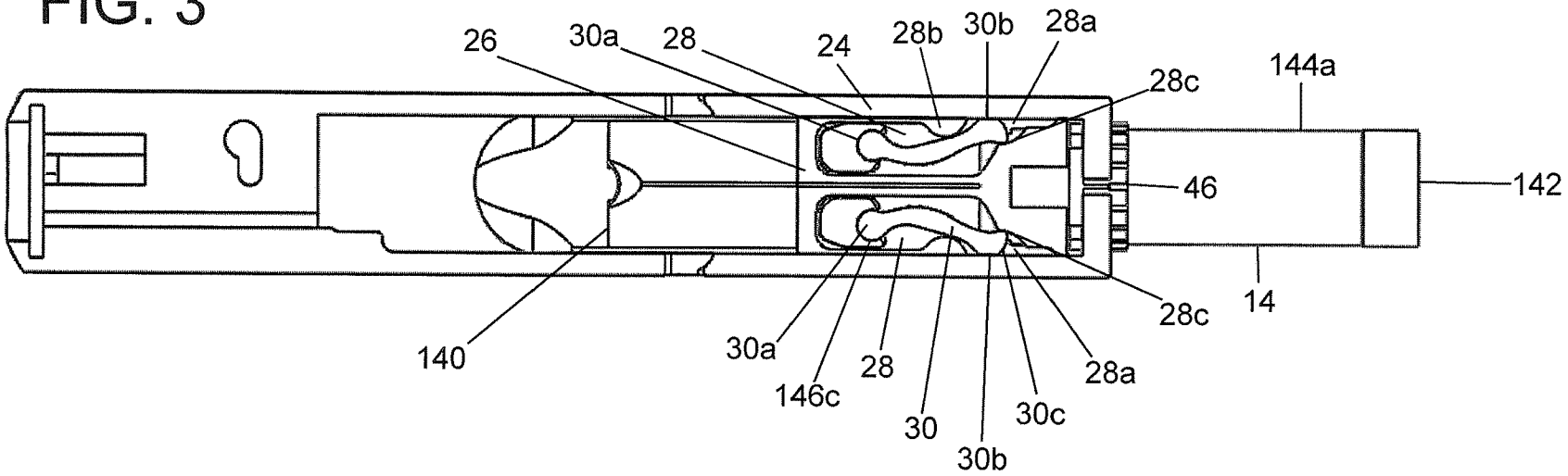
Figure 4:
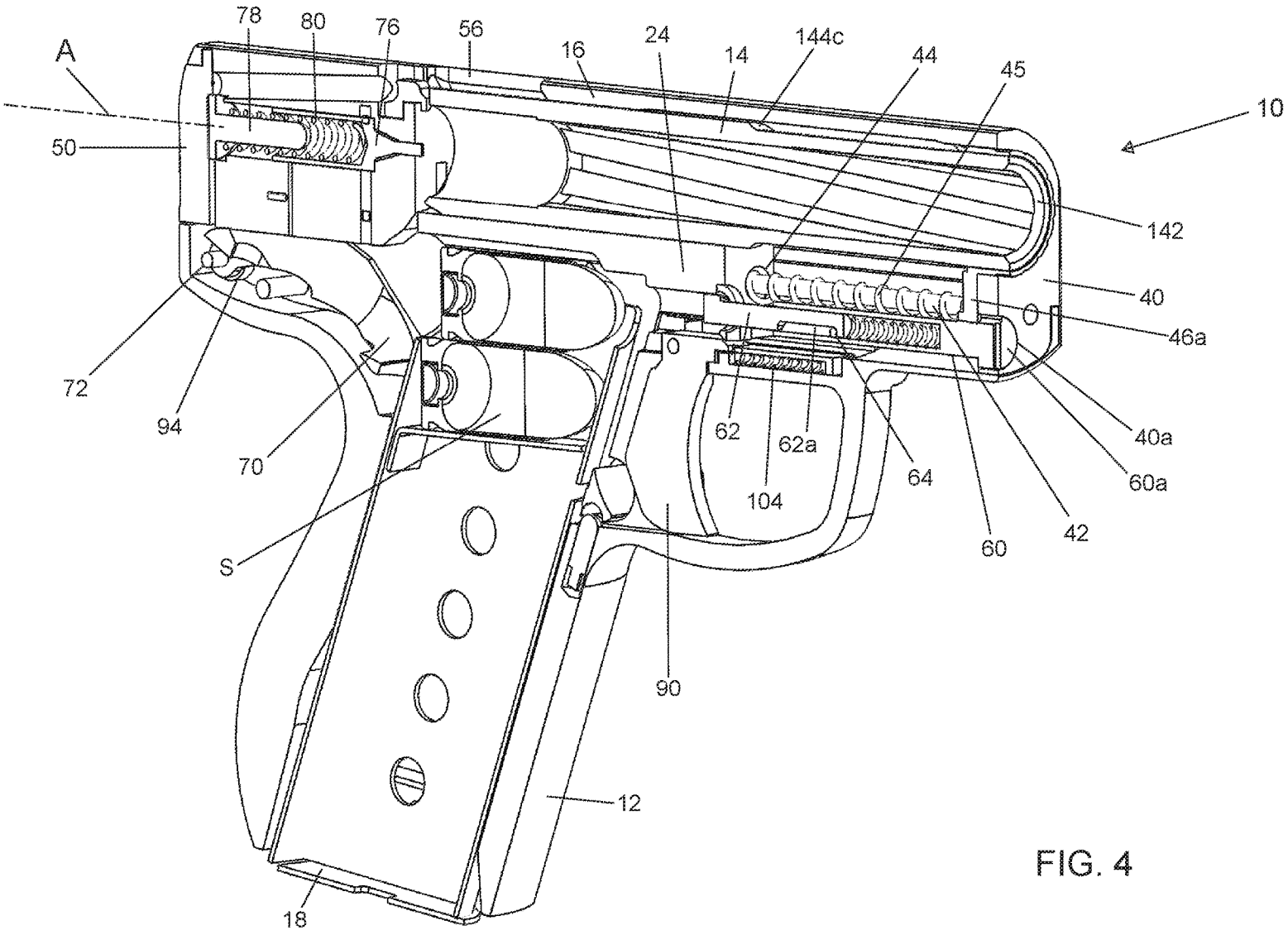
FIG. 4 shows a vertical, cross sectional, perspective view of the firearm of FIG. 1.
Figure 5:
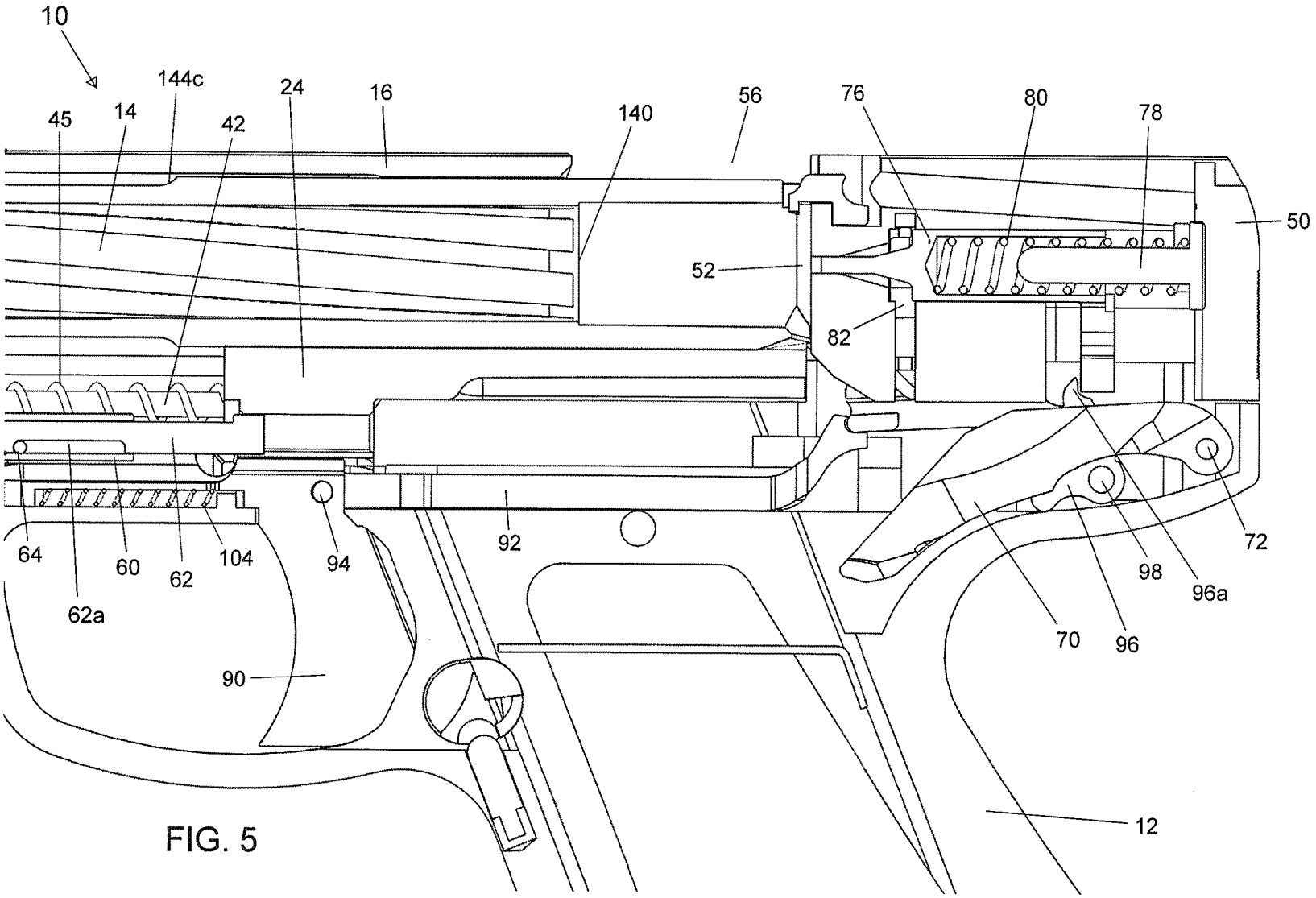
FIG. 5 shows a partial vertical cross sectional view of the firearm of FIG. 1.
Figure 6:
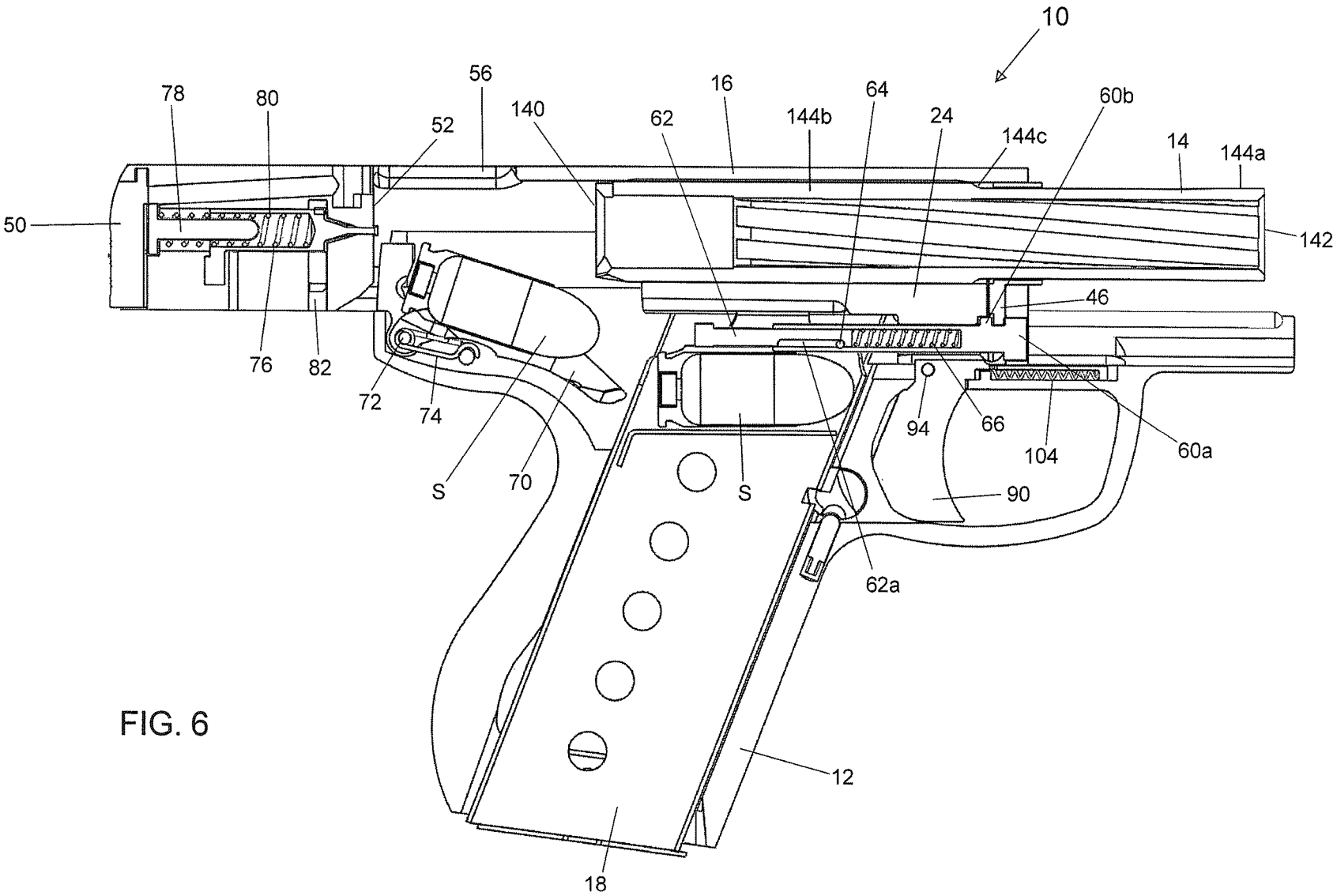
FIG. 6 shows a vertical, cross sectional view of the firearm of FIG. 1 in an alternate position than shown in FIG. 4.

All figures are drawn for ease of explanation of the basic teachings only; the extensions of the figures with respect to number, position, relationship, and dimensions of the parts to form the illustrative embodiments will be explained or will be within the skill of the art after the following description has been read and understood. Further, the exact dimensions and dimensional proportions to conform to specific force, weight, strength, and similar requirements will likewise be within the skill of the art after the following description has been read and understood.

Where used in the various figures of the drawings, the same numerals designate the same or similar parts. Furthermore, when the terms "top", "bottom", "first", "second", "forward", "rearward", "reverse", "front", "back", "height", "width", "length", "end", "side", "horizontal", "vertical", and similar terms are used herein, it should be understood that these terms have reference only to the structure shown in the drawings as it would appear to a person viewing the drawings and are utilized only to facilitate describing the illustrative embodiments.

DESCRIPTION OF THE ILLUSTRATIVE EMBODIMENTS

A firearm 10 is shown and described in an illustrative embodiment as a pistol and generally includes a frame 12 to which a barrel 14 and a slide 16 are slideably mounted and in which a magazine 18 is slideably received. Magazine 18 is of a conventional design in which shells S in a parallel longitudinal stacked relation are biased toward a top having its front and back cut in relief to allow shell S to slide longitudinally out of the back. It should be appreciated that magazine 18 can be of a variety of designs and configurations different from the form shown and described but which is compatible to features and elements desired in firearm 10 so will not be described in detail further.

A cam block 24 is fixed to frame 12 and includes an upper cradle 26 for slideably receiving barrel 14. Barrel 14 generally includes a rearward end 140 and a forward end 142 longitudinally spaced from rearward end 140. The outer surface includes a reduced diameter portion 144*a* extending from forward end 142 towards but spaced from rearward end 140 and a larger diameter portion 144*b* extending from the rearward end 140 and terminating at a circumferential shoulder 144*c* with portion 144*a*. Barrel 14 further includes first and second circumferentially spaced lugs 146 located on portion 144*b* intermediate and spaced from rearward end 140 and shoulder 144*c*. Lugs 146 are circumferentially spaced less than 180° and in the form shown are generally at the 5 and 7 o'clock position relative to the longitudinal axis of the barrel 14.

Firearm 10 further includes a pair of locking wings 30 pivotally connected to lugs 146 of barrel 14 about parallel, spaced pivot axes extending tangentially to the longitudinal axis of barrel 14. In the form shown, each of lugs 146 includes a generally semi-circular cavity 146*c* which slideably receives an end 30*a* of a corresponding locking wing 30 which generally allows slideable receipt in a direction parallel to the pivot axis and allows pivotable movement about the pivot axis through an acute angle but generally prevents movement in a direction perpendicular to the pivot axis. Each locking wing 30 includes a lock tab 30*b* formed adjacent the end 30*c* opposite to end 30*a* and located on the outer surface thereof. Each locking wing 30 further includes an outer camming surface 30*d* located on the outer surface intermediate lock tab 30*b* and end 30*a* and an inner camming surface 30*e* located on the inner surface and opposite to lock tab 30*b* and outer camming surface 30*d*.

Cradle 26 of cam block 24 includes a pair of troughs 28 slideably receiving lugs 146 and wings 30 and terminating in access openings 28*a*. Each trough 28 includes an outer cam track 28*b* complementary to and for operatively engaging with outer camming surface 30*d* and an inner cam track 28*c* complementary to and for operatively engaging with inner camming surface 30*e*.

Thus, with movement of barrel 14 relative to cam block 24, locking wings 30 move between an extended position and a retracted position. Specifically, with barrel 14 in a forward position relative to cam block 24, locking wings 30 are in the extended position, with each lock tab 30*b* extending out of access opening 28*a* and radially outward of cradle 26 and cam block 24, and inner camming surface 30*e* abutting with inner cam track 28*c*, and with barrel 14 in a rearward position relative to cam block 24, locking wings 30 are in the retracted position with each lock tab 30*b* not extending out of access opening 28*a* and radially extensive or inwardly of cam block 24.

Slide 16 is generally channel shaped and is suitably slideably mounted for longitudinal movement relative to frame 12 such as by parallel slide rails 12*a* located in frame 12 and slideably related to parallel slide tracks 16*a* formed in slide 16. Slide 16 further includes an integral end piece 40 at the forward end thereof. A pair of slide pins 42 are slideably received in slide apertures 44 formed in cam block 24 for longitudinal movement relative thereto. The free ends of slide pins 42 are suitably mounted to end piece 40 such as being slideable in holes in end piece 40. Slide 16 is suitably biased relative to cam block 24 such as by springs 45 located on slide pins 42 intermediate cam block 24 and end piece 40. Slide 16 is also slideable relative to barrel 14. In the form shown, a bushing 46 extends through end piece 40 and slideably receives portion 144*a*. Thus, bushing 46 acts as a guide for slide 16 sliding rearwardly on portion 144*a* of barrel 14. Barrel 14 is slideably received on cradle 26 and inside slide 16.

Slide 16 further includes an end piece 50 at the rearward end thereof and longitudinally opposite end piece 40. Further, slide 16 includes a tab 52 located intermediate and spaced from end pieces 40 and 50. An ejection hole 56 is formed in slide 16 intermediate end piece 40 and tab 52 and adjacent to tab 52. Slide 16 further includes a pair of locking recesses 58 shown as through holes for receiving lock tabs 30*b* of locking wings 30. Specifically, with slide 16 and barrel 14 in a forward position relative to cam block 24, the pair of locking wings 30 are in their extended position with lock tabs 30*b* extending out of access openings 28*a* and into locking recesses 58 to lock barrel 14 and slide 16 together. If slide 16 is moved rearward relative to frame 12 against the bias of springs 45, barrel 14 will initially move with slide 16 relative to cam block 24 due to lock tabs 30*b* extending into locking recesses 58. However, as barrel 14 moves rearward, locking wings 30 will travel in troughs 28 such that outer camming surfaces 30*d* engage with outer cam tracks 28*b* to retract lock tabs 30*b* from locking recesses 58, such that slide 16 is able to slide relative to frame 12 as well as barrel 14. When slide 16 is moved forward relative to cam block 24, the rearward end 140 of barrel 14 engages tab 52 so that barrel 14 and slide 16 move together. With forward movement of barrel 14, inner camming surfaces 30*e* engage with inner cam tracks 28*a* to move locking wings 30 from their retracted position to the extended position to again lock barrel 14 and slide 16 together.

A push rod 60 is suitably fixed to end piece 40 and extends longitudinally spaced from and parallel to barrel 14. In the form shown, push rod 60 has a head 60*a* including a suitable tool engagement portion to allow rotation of push rod 60 in a bore 40*a* formed in end piece 40. Push rod 60 further includes a radially extending tab 60*b* axially spaced from head 60*a*. Bushing 46 also includes a radially extending ear 46*a* having a recess abuttable with push rod 60. Thus, push rod 60 is rotatable between a securement position with ear 46*a* and end piece 40 sandwiched between tab 60*b* and head 60*a* to fix bushing 46, slide 16, and push rod 60 together and a non-interfering position such that relative movement of bushing 46, slide 16, and push rod 60 is permitted. A bumper 62 formed of energy absorbing material such as hard rubber or metal is suitably slideably mounted relative to push rod 60 and is biased in a rearward direction relative thereto. In the form shown, push rod 60 is tubular and particularly cylindrical, with bumper 62 being slideably received therein. Bumper 62 includes a recess 62*a*, with a pin 64 extending though push rod 60 and located within recess 62*a* to define the extent of slideable movement. A spring 66 is sandwiched between head 60*a* and bumper 62 to bias bumper 62 out of push rod 60.

When slide 16 is slid rearward, push rod 60 fixed to end piece 40 moves longitudinally parallel to barrel 14 until the bumper 62 engages with the forward end of the upper-most shell S biased against the top of magazine 18. Further movement of slide 16 causes shell S to be pushed rearward onto a carrier 70 in a lowered position and/or to push bumper 62 into push rod 60 against the bias of spring 66. Spring 66, or an equivalent element such as an air or oil shock, absorbs the impact of bumper 62 on the first end of the shell S as push rod 60 moves backward, to prevent damage to shell S and to adjust to accommodate shells S of differing lengths, styles, calibers, types or the like.

Carrier 70 is pivotally mounted to frame 12 by a carrier pin 72 and is biased from the lower position to a raised position such as by a torsion spring 74 shown. Carrier 70 is located in its raised position when slide 16 is in its rearward position and is moved to its lowered position by ramps 16*b* inside of slide 16. A striker 76 is telescopically mounted upon a pin 78 connected to end piece 50, is movable along a longitudinal axis A relative to frame 12, and is biased forward such as by a compression spring 80 concentrically located on pin 78 and sandwich between end piece 50 and striker 76. A safety 82 is slideably mounted in tracks 16*c* formed in slide 16 and includes an interacting position interacting with striker 76 to prevent movement thereof through a hole in tab 52 and a firing position which does not interact with striker 76.

A trigger 90 shown as of a slide type is slidably mounted in grooves formed in frame 12 and held in place by cam block 24. Trigger 90 is biased in a forward position such as by a compression spring 104. The front of a transfer bar 92 is pivotally attached to trigger 90 by a cross pin 94. Transfer bar 92 is slideably sandwiched in a groove in frame 12 by magazine 18 received therein. A sear lever 96 is pivotally mounted in frame 12 by a cross pin 98 and includes a face 96*a* which engages striker 76. Sear lever 96 is suitably biased to move face 96*a* towards striker 76 in any suitable manner such as by a torsion spring 100, an extension spring or the like. A linkage 102 shown in the shape of a dog bone has a first end which is pivotally captured to a lobe 96*b* of sear lever 96 and a second end which is pivotally cradled to the rear of transfer bar 92. Specifically, the rear of transfer bar 92 includes a semicircular landing that cradles the second end of the linkage 102, while the first end of linkage 102 is semicircular in shape and is captured in a concentric pocket formed in lobe 96*b* of sear lever 96.

Trigger 90 is actuated by pulling it rearwards. As trigger 90 goes rearwards, cross pin 94 transfers the rearward motion to transfer bar 92. Transfer bar 92 pushes on the second end of linkage 102, and linkage 102 while going backwards lifts safety 82. Linkage 102 pushes on and rotates sear lever 96. Sear lever 96 pushes striker 76 backwards loading spring 80. As sear lever 96 clears striker 76 while pivoting, striker 76 is pushed forward by spring 80. Linkage 102 has lifted safety 82 clear of striker 76 allowing striker 76 to go through the striker pin hole in tab 52 and hit the primer on shell S held on the breach face of slide 16. Upon firing, slide 16 moves backwards towards the rearward stop of slide 16. At its rearward stop, the momentum of striker 76 pushes it backwards and allows safety 82 to reset. Upon clearing frame 12, carrier 70 lifts linkage 102 off transfer bar 92, and spring 100 forces sear lever 96 and linkage 102 forwards towards the muzzle end of firearm 10. Sear lever 96 resets and, as slide 16 comes forward, picks up striker 76. Trigger 90 is released and moves forward via compression spring 104. Trigger 90 pulls transfer bar 92 forward, and linkage 102 drops onto the semicircular landing at the back of transfer bar 92. This resets the trigger mechanisms. Firearm 10 is then in a forward rest position with breach face tab 52 of slide 16 in contact with rearward end 140 of barrel 14 and locking wings 30 received in locking recesses 58.

Carrier 70 is held down by slide 16 until slide 16 reaches its rearward most position. Once in the rearward position, spring 74 is allowed to act on carrier 70 lifting shell S and pivoting carrier 70 until carrier 70 contacts barrel 14 and aligning carrier 70 and barrel 14 to make a feed ramp. With that motion, slide 16 is moved backwards to its most rearward position, and shell S is moved onto carrier 70. Carrier 70 is shaped on top to time the position of carrier 70 as the breach face of slide 16 clears frame 12. Once the breach face of slide 16 clears frame 12, spring 74 forces carrier 70 to pivot on carrier pin 72 in an upwards motion creating a feed ramp for shell S to move up into the chamber. Carrier 70 and shell S rotate up until it contacts barrel 14. Barrel 14 is used in this way to prevent carrier 70 from over rotation. Barrel 14 is one method to stop rotation of carrier 70, but frame 12 could also be used to stop carrier 70. As slide 16 moves to return forward, slide 16 pushes shell S forward into barrel 14 and forces carrier 70 back down into frame 12. Springs 45 loaded by slide 16 moving backwards now starts the return cycle of slide 16. Springs 45 rebound and force slide 16 forwards, and shell S is pushed up carrier 70 and into barrel 14. Slide 16 continues forward, and breach face tab 52 of slide 16 contacts barrel 14 and starts barrel 14 moving forward. As barrel 14 is moving forward, lock tabs 30*b* of locking wings 30 are pushed outward by inter tracks 28*c*. Locking wings 30 then are pushed back into locking recesses 58 of slide 16. Once into locking recess 58 of slide 16, locking lugs 146 and barrel 14 travel forward a given distance to the forward stop. Push rod 60 and bumper 62 travel in a linear fashion back forward in unison with slide 16 and clear magazine 18 allowing the next shell S in magazine 18 to rise into position and be centered in front of bumper 62.

Reliability of feeding shell S, the shell size and useable power of shell S are increased by transferring linear energy from the motion of slide 16 when in its most forward position to bushing 46 connected to push rod 60 and as slide 16, bushing 46 and push rod 60 all move as one piece rearwards, moving spring 66 located inside push rod 60. Spring 66 then moves bumper 62 through cam block 24, with bumper 62 making contact with shell S located at the top of magazine 18. Shell S is then pushed backwards out of magazine 18 onto carrier 70 that will lift shell S once slide 16 reaches its most rearward position. Once there, slide 16 will collect the rear of shell S and push shell S forward into barrel 14. In order to achieve this action in the form shown, barrel 14 must maintain a linear motion matching slide 16.

The illustrative embodiment shown has distinct advantages over conventional methods for locking slides to the barrel as the width of frame 12 and slide 16 can be kept to a minimum. Specifically, the pair of locking wings 30 used in conjunction with slide 16 greatly reduces the profile of the locking mechanism. Barrel 14 is held by cam block 24 that enables its forward and rearward movement in conjunction with slide 16. When slide 16 is in its most forward position, barrel 14 and both locking wings 30 are connected via barrel 14 having semicircular cavities 146*c* located on the bottom of barrel 14. Locking wings 30 are circular at ends 30*a* to be held by barrel 14. Cam block 24 provides troughs 28 for locking wings 30 to move axially and not up or down. Locking wings 30 will move forward and backwards with barrel 14 and are actuated by cam block 24. When slide 16 starts to move as a result of shell S being fired or the operator moving slide 16 by hand, barrel 14, locking wings 30, and slide 16 all move as one until cam block 24 acts on locking wings 30 forcing them inwards to allow slide 16 to move freely and eject the spent shell S or load a new shell S. The trigger mechanism is also linear in profile and motion to enable push rod 60 the clearance necessary to make contact with shell S located in magazine 18. Magazine 18 allows shell S that is pushed backwards, an exit position to the rear of magazine 18 and onto carrier 70.

Now that the basic teachings of an illustrative embodiment have been explained, many extensions and variations will be obvious to one of ordinary skill in the art. For example, although a pistol is shown as the illustrative embodiment, firearms of other types and configurations, including, but not limited to, shotguns, rifles, semi-automatic, automatic, etc., can incorporate one or more of the improved elements and methods of operations disclosed herein. Similarly, although believed to produce synergistic results as discussed herein, the improved elements and methods of operations disclosed herein can be used singularly and/or in other combinations and will provide advantages over conventional firearms.

Thus since the invention disclosed herein may be embodied in other specific forms without departing from the spirit or general characteristics thereof, some of which forms have been indicated, the embodiments described herein are to be considered in all respects illustrative and not restrictive. The scope of the invention is to be indicated by the appended claims, rather than by the foregoing description, and all changes which come within the meaning and range of equivalency of the claims are intended to be embraced therein.

The invention claimed is:

1. Firearm comprising, in combination: a frame; a barrel carried by the frame; a slide slideable along a longitudinal axis relative to the frame; a trigger moveably mounted to the frame; a striker moveably mounted relative to the frame for striking a bullet located in the barrel, with the trigger operatively connected to the striker; a magazine slideably received in the frame, with the magazine having a top having a front and back cut in relief, with the magazine holding a shell extending parallel to the longitudinal axis against the top; a push rod mounted to the slide parallel to the longitudinal axis and aligned with the shell in the magazine; and a bumper slideably mounted to the push rod for movement parallel to the longitudinal axis relative to the push rod and biased toward the magazine and engaging with the shell in the magazine.

2. A firearm comprising, in combination: a frame; a barrel carried by the frame; a slide slideable along a longitudinal axis relative to the frame; a trigger moveably mounted to the frame; a striker moveably mounted relative to the frame for striking a bullet located in the barrel, with the trigger operatively connected to the striker; a magazine slideably received in the frame, with the magazine having a top having a front and back cut in relief, with the magazine holding a shell extending parallel to the longitudinal axis against the top; a push rod mounted to the slide parallel to the longitudinal axis and aligned with the shell in the magazine; and a bumper slideably mounted to the push rod and biased toward the magazine and engaging with the shell in the magazine, wherein the push rod is tubular and includes a head, wherein the bumper is slideably received in the push rod; and wherein a biasing element is located in the push rod and sandwiched between the head of the push rod and the bumper.

3. The firearm as defined in claim 2, wherein the bumper includes a recess, wherein a pin extends through the push rod and the recess to define a slide extent of the bumper; wherein the biasing element is a compression spring; and wherein the barrel is parallel to the longitudinal axis, with the slide slideable relative to the barrel.

* * * * *